US011802352B2

(12) United States Patent
Lin

(10) Patent No.: US 11,802,352 B2
(45) Date of Patent: Oct. 31, 2023

(54) YARN MAKING METHOD

(71) Applicant: KENNWARR CO., LTD., Toufen (TW)

(72) Inventor: Kuei Jung Lin, Toufen (TW)

(73) Assignee: KENNWARR CO., LTD., Toufen (TW)

( * ) Notice: Subject to any disclaimer, the term of this patent is extended or adjusted under 35 U.S.C. 154(b) by 0 days.

(21) Appl. No.: 17/744,731

(22) Filed: May 16, 2022

(65) Prior Publication Data

US 2022/0372670 A1 Nov. 24, 2022

(30) Foreign Application Priority Data

May 24, 2021 (TW) ..... 110118719

(51) Int. Cl.

| | |
|---|---|
| ***D02G 1/02*** | (2006.01) |
| ***D02G 3/04*** | (2006.01) |
| ***D02G 3/26*** | (2006.01) |
| ***D02G 1/08*** | (2006.01) |
| ***D02G 1/16*** | (2006.01) |
| ***D02G 1/20*** | (2006.01) |

(52) U.S. Cl.

CPC ..... *D02G 1/0266* (2013.01); *D02G 1/0293* (2013.01); *D02G 1/08* (2013.01); *D02G 1/165* (2013.01); *D02G 1/20* (2013.01); *D02G 3/04* (2013.01); *D02G 3/26* (2013.01); *D10B 2201/02* (2013.01); *D10B 2331/04* (2013.01)

(58) Field of Classification Search

CPC ..... D02G 1/0266; D02G 1/0293; D02G 1/08; D02G 1/165

See application file for complete search history.

(56) References Cited

U.S. PATENT DOCUMENTS

| | | | | |
|---|---|---|---|---|
| 10,220,407 | B2 * | 3/2019 | Lin | D02J 7/00 |
| 2013/0302605 | A1 * | 11/2013 | Yang | D01F 9/12 264/105 |
| 2014/0050920 | A1 * | 2/2014 | Ray | D02G 3/16 57/232 |
| 2015/0152852 | A1 * | 6/2015 | Li | D01H 1/10 60/527 |
| 2017/0275789 | A1 * | 9/2017 | Dias | D02G 3/22 |
| 2020/0399821 | A1 * | 12/2020 | Yoshioka | B07B 1/4672 |

* cited by examiner

*Primary Examiner* — Shaun R Hurley

(74) *Attorney, Agent, or Firm* — Leong C. Lei

(57) ABSTRACT

A yarn making method includes a raw-material yarn; first rollers pulling the raw-material yarn; an entangling point generator subjecting the yarn to jet-forming of entangling points; a cleansing chamber cleansing the yarn that has generated the entangling points; a material chamber provided with a graphene-containing attachment material to be attached to the yarn that has generated the entangling points and has been cleansed; second rollers pulling the yarn that has past the entangling point generator, the cleansing chamber, and the material chamber; a heating chamber having the attachment material secured to the yarn by means of heat-setting; third rollers controlling a heating time of the yarn in the heating chamber; and fourth rollers winding and shaping the processing-completed yarn so as to have the graphene-containing attachment material long preserved in clothing.

15 Claims, 4 Drawing Sheets

YARN MAKING METHOD

TECHNICAL FIELD OF THE INVENTION

The present invention relates generally to a yarn making method, which makes characteristics of a graphene-containing attaching material present in a yarn to enhance temperature-increasing and warm-keeping properties of clothing.

DESCRIPTION OF THE PRIOR ART

In the wintertime, people put on heavy clothing to keep themselves warm. Traditionally, warm-keeping clothing is primarily made of cotton or wool, and after the development of the chemical fiber industry, yarns made of man-made fibers are used.

For the traditional warm-keeping clothing, the thickness of the clothing is generally in proportion to the demand for warm keeping, so that body temperature may be isolated by the thickness. The thicker the clothing is, the less degree the heat is dissipating. However, thick clothing indicates more material is consumed and the person wearing the clothing may suffer reduced activity, and more spaces are needed for stowage with the change of seasons.

Nowadays, polar fleece technology and fibers added with mineral-based far infrared light are also used. However, polar fleece may generate a great lot of plastic particles and plastic fibers, and such plastic particles and plastic fibers cannot be intercepted by the sewage systems, nor be effectively blocked by the sewage treatment plants and will attach to various substances, including toxicant organic compounds, algae, and microorganisms, in their ways of flowing toward the oceans, and would, afterwards, be consumed by innocent aquatic organisms, including fishes, shrimps, shellfishes and crabs, all being hard to avoid such a situation. Such plastic particles so consumed accordingly enter the food chains. The related contamination will eventually be accumulated in the large-sized aquatic animals, and even human bodies, and this, as revealed in contemporary studies, leads to human cancels, lowered fertility, reduced immunity, and monstrous births. In consideration of environmental protection, fleece clothing will be gradually weeded out.

Further, some manufacturers make addition, in the form of far infrared powder, such as zirconium oxide, in the processes of making fibers. However, in the subsequent processes of yarn formation, in which pigments and setting agents are added, the far infrared particles are set further away from human body. Further, in the winters when sunlight is generally short, the far infrared powder may not get fully effective, and cannot achieve the desired functions of warm keeping and temperature rising.

SUMMARY OF THE INVENTION

Disclosed is a yarn making method, which comprises a raw-material yarn;

first rollers, which pull the raw-material yarn;

an entangling point generator, which is arranged posterior to the first rollers to subject the yarn to jet-forming and generating of entangling points;

a cleansing chamber, which is arranged posterior to the entangling point generator to cleanse the yarn that has generated the entangling points;

a material chamber, which is provided with a graphene-containing attachment material to have the yarn that has generated the entangling points and has been cleansed attached with the graphene-containing attachment material;

second rollers, which are arranged posterior to the material chamber to pull the yarn that has past the entangling point generator, the cleansing chamber, and the material chamber;

a heating chamber, which is arranged posterior to the second rollers to have the graphene-containing attachment material provided from the material chamber securely attached to each individual fiber of the yarn by means of heat-setting;

third rollers, which are arranged posterior to the heating chamber to control a heating time of the yarn in the heating chamber; and fourth rollers, which are arranged posterior to the third rollers to wind and shape the processing-completed yarn.

In the method, the raw-material yarn includes polyester false-twisted filament, nylon false-twisted filament, polyester/nylon filament, polyester/nylon fiber, and polyester/cotton blended yarn. The raw-material yarn is arranged in a yarn roll that is disposed on a yarn release stand. The first rollers pull forward the raw-material yarn, and the first rollers pull 100-1000 meters per minute to pull the raw-material yarn to subsequent working stages. The entangling point generator is arranged posterior to the first rollers to subject the yarn to jet-forming of entangling points, meaning an air jet nozzle is used in processing polyester or polyamide textured yarn, so as to have fibers generating point-like packed entangling phenomena to make 80-120 entangling points in each meter of the yarn. The cleansing chamber is arranged posterior to the entangling point generator to cleanse the yarn that has generated the entangling points, wherein the cleansing chamber applies a clear water rinsing process to wash out residual oil stains on the yarn in order to prevent the oil stains, generated after the yarn is being subjected to forming of the entangling points, from affecting attaching of the attachment material thereto. The cleansed yarn is then fed to the material chamber for processing. The material chamber is provided with the attachment material to have the attachment material attached to the yarn that has generated the entangling points and has been cleansed. The attachment material can be a graphene-containing attachment material, and the yarn that has generated the entangling points and has been cleansed is attached with the graphene-containing attachment material.

The graphene attachment material comprises water, a high molecular polymer, and graphene particles. The high molecular polymer is acrylic, or polyurethane (PU), or polyester. After stirring, the graphene-containing attachment material is attached to the yarn that passes through the material chamber. Any object having a temperature higher than absolute zero degree shows radiation. The normal temperature of a human body is around 37° C. and the radiation that is calculated with known formulas has an electromagnetic wave peak of around 9.5 μm. An object may readily absorb energy close to a radiation peak value thereof, and thus, far infrared light having a wavelength range of 8-14 μm can be easily absorbed by a human body. Graphene when heated generates far infrared light of 8-14 μm that is close to human body wavelength. The far infrared light generated by heated graphene is very close to human body wavelength, both being 8-15 um. When wavelengths that are equivalent are interacting with each other, a resonant phenomenon occurs. When a resonance effect occurs on biological cells, far infrared thermal energy may deeply get into the subcutaneous tissues, making capillary blood vessels expanding and enhancing blood circulation, and thus helping increasing body temperature.

Further, common graphene particles are mostly of a geometric shape of circle. A circle makes any incident energy hard to control due to the surface curvature and is hard to resonate with the far infrared light radiating from human body. In view of such, specifically manufactured graphene particles that are rectangular in shape having a length of 3-20 μm, a width of 8-25 μm, and a thickness of 3-12 nm are used such that when the rectangular graphene particles are located on a surface of the yarn, they can more easily resonate with the radiation generated by the human body.

The second rollers are arranged posterior to the material chamber to pull the yarn that has past the entangling point generator, the cleansing chamber, and the material chamber. The heating chamber is arranged posterior to the second rollers to have the attachment material provided from the material chamber securely attached to each individual fiber of the yarn by means of heat-setting, and the heating chamber has a heating temperature of 100-600 degrees Celsius. The third rollers are arranged posterior to the heating chamber to control the heating time of the yarn in the heating chamber, and the third rollers pull 100-1000 meters per minute to control the heating time of the yarn in the heating chamber. The fourth rollers are arranged posterior to the third rollers to wind and shape the yarn that has been completed the processing.

As such, the yarn so completed the processing possesses the property of the graphene-containing attachment material.

DETAILED DESCRIPTION OF THE PREFERRED EMBODIMENT

Figure 1:
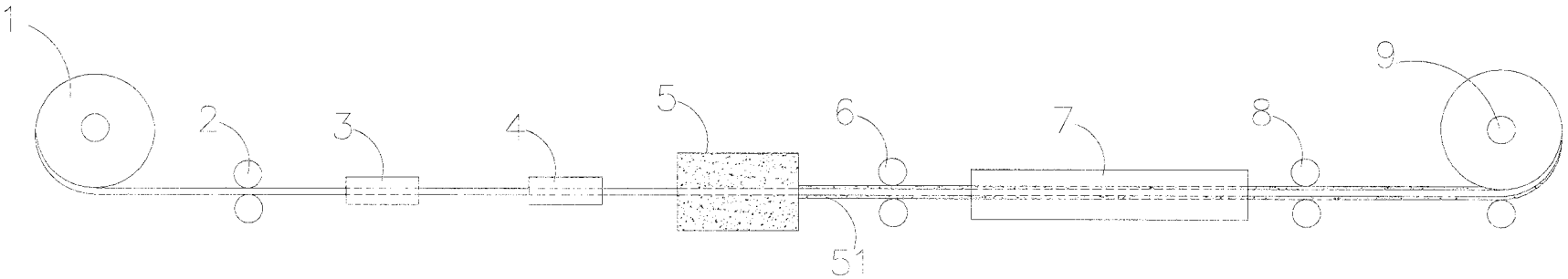
FIG. 1 is a schematic view demonstrating a flow of a graphene-contained yarn making method according to the present invention.
Figure 2:
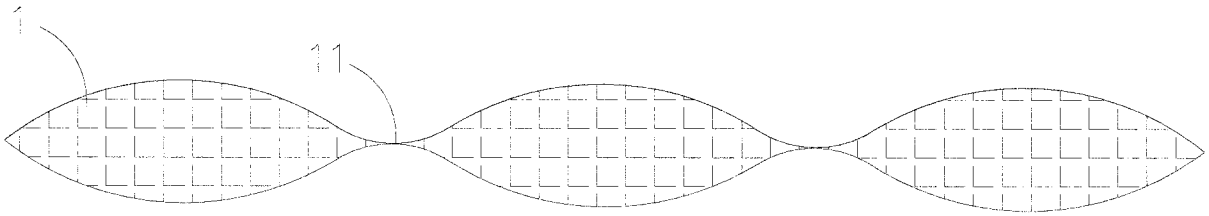
FIG. 2 is a schematic view illustrating entanglement points according to the present invention.
Figure 3:
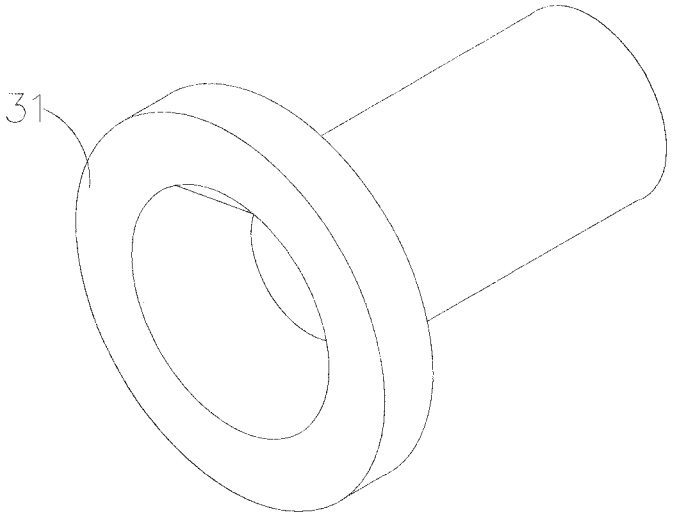
FIG. 3 is a schematic view showing an air jet nozzle according to the present invention.

Referring to FIGS. 1-3, for a raw-material yarn (1), the raw-material yarn (1) is generally in the form of a roll of yarn wound around a center-hollowed spool. For the yarn of the center-hollowed spool, the hollowed part is fit on a yarn releasing stand having a spool axle. The raw-material yarn (1) includes polyester false-twisted filament, nylon false-twisted filament, polyester/nylon filament, polyester/nylon fiber, and polyester/cotton blended yarn.

First rollers (2) pull the raw-material yarn (1), the first rollers being operable to pull 100-1000 meters per minute to pull the raw-material yarn (1) to subsequent working stages.

An entangling point generator (3) is arranged posterior to the first rollers (2) to subject the raw-material yarn (1) to jet-forming of entangling points (11), wherein the processing uses an air jet nozzle (31) to make the fiber generate packed entangling phenomena in the form of node points, meaning pressurized air is introduced into the nozzle to generate swirling flows to make the yarn possess homogenate physical property to facilitate processing in the subsequent working stages.

The entangling point generator (3) uses the air jet nozzle (31) to cause, during the processing, polyester or polyamide textured yarn to have fibers generating point-like packed entangling phenomena so as to make 80-120 entangling points in each meter of the yarn.

A cleansing chamber (4) is arranged posterior to the entangling point generator (3) to cleanse the yarn (1) that has generated the entangling points, wherein the cleansing chamber is operated with clear water rinsing to remove residual oil and contaminants from the yarn, and clear water rinsing can be rinsing through dipping in water or spraying of water, so as to make the raw-material yarn (1), before the next working stage, keep the yarn clean and free of foreign object attached thereto.

A material chamber (5) is provided with a graphene-containing attachment material (51), so that the raw-material yarn (1) that has generated the entangling points and has been cleansed is attached with the graphene-containing attachment material (51), wherein the graphene-containing attachment material (51) includes: a high molecular polymer and water, and the high molecular polymer is acrylic or polyurethane (PU) or polyester, and a ratio of graphene in the entirety of attachment material is from 0.1 percent to 3 percent; and a ratio of the high molecular polymer is from 10 percent to 69.9 percent, a ratio of water being from 30 percent to 89.9 percent, wherein graphene, high molecular polymer, and water are stirred for 20 to 28 hours with a stirrer motor at a rotational speed of 1000-5000 revolutions per minute and are then introduced into the material chamber (5) to serve as the attachment material (51), wherein graphene can be of a rectangular shape having a length of 3-20 μm, a width of 8-25 μm, and a thickness of 3-12 nm.

Second rollers (6) are arranged posterior to the material chamber (5) to pull the raw-material yarn (1) that has past the entangling point generator (3), the cleansing chamber (4), and the material chamber, wherein the second rollers pull forwards 100-1000 meter per minute to provide a pulling force for the raw-material yarn (1) to pass through the previous working stages.

A heating chamber (7) is arranged posterior to the second rollers (6) to have the graphene-containing attachment material (51) provided from the material chamber (5) securely attached to each of individual fibers of the raw-material yarn (1) by means of heat-setting, wherein the heating chamber (7) has a temperature of 100-600 degrees Celsius.

Third rollers (8) are arranged posterior to the heating chamber (7) to control a heating time of the raw-material yarn (1) in the heating chamber, wherein the third rollers (8) have a rotational speed for pulling 100-1000 meters per minute and allows the raw-material yarn (1) passing through the heating chamber (7) to subject to optimum heating for temperature homogeneity at 100-600 degrees Celsius.

Fourth rollers (9) are arranged posterior to the third rollers (8) to wind the yarn so processed for shaping, wherein the fourth rollers pull forward 100-1000 meters per minute to wind and shape the processing-completed yarn.

Figure 4:
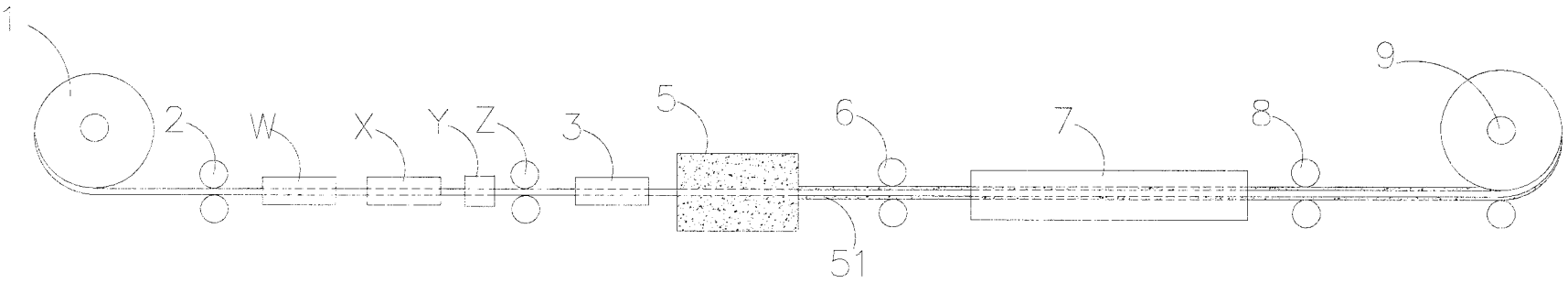
FIG. 4 is another schematic view demonstrating a flow of a graphene-contained yarn making method according to the present invention.

As shown in FIG. 4, for the raw-material yarn (1) being polyester filament (POY or FDY) (POY stands for partially oriented yarn and FDY stands for fully drawn yarn) and nylon filament (POY or NFDY) (NFDY stands for nylon fully drawn yarn), further arranged posterior to the first rollers (2) is a pre-heating chamber (W), wherein the pre-heating chamber (W) has a temperature of 100-600 degrees Celsius, and further arranged posterior thereto is a cooling board (X), wherein the cooling board (X) is operable to ensure the yarn is subjected to heating and setting in a twisted condition, and a length of the cooling board (X) from an exit of the pre-heating chamber (W) to the false-twisting mechanism (Y) is 0.5-1.5 meters to allow the yarn to cool down a temperature below 100° C. before de-twisting for facilitating setting. Arranged posterior to the cooling board (X) are a false-twisting mechanism (Y) and pulling rollers (Z) for pulling forward the three pre-stages in order to make the polyester filament or nylon filament become a textured filament.

Figure 5:
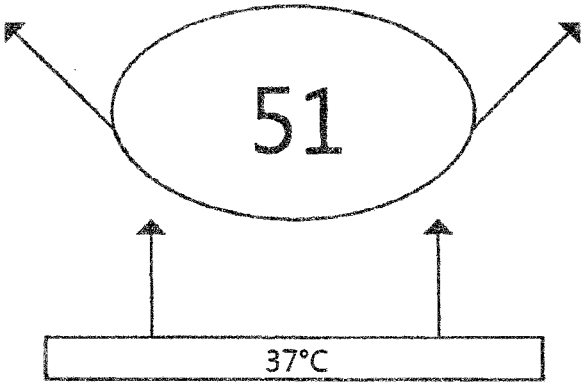
FIG. 5 is a schematic view demonstrating dissipation of thermal radiation for prior art far infrared powder.
Figure 6:
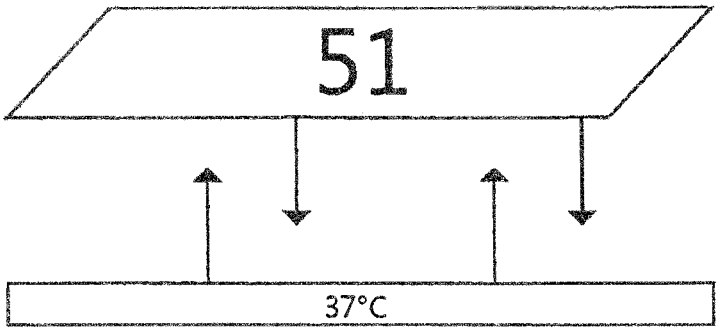
FIG. 6 is a diagram of reflection of thermal radiation for the graphene-contained yarn according to the present invention.

The textured yarn so obtained through the above-described stages possesses the characteristics of the graphene attachment material according to the present invention, heat radiation of regular powder including far infrared particles of FIG. 5 and heat radiation of the graphene-containing attachment material in a shape according to the present invention of FIG. 6. Such a yarn, when being to be made into clothing, is subject to dyeing, and the property of the rectangular attachment material of graphene is included in the dyeing process and is thus before heat-setting of the yarn fabrication and the dyeing process and the heat-setting thereof, so that the attachment material of the clothing shows better stability for the property.

I claim:

1. A yarn making method, comprising a raw-material yarn;

first rollers, which pull the raw-material yarn;

an entangling point generator, which is arranged posterior to the first rollers to subject the yarn to jet-forming and generating of entangling points;

a cleansing chamber, which is arranged posterior to the entangling point generator to cleanse the yarn that has generated the entangling points;

a material chamber, which is provided with a graphene-containing attachment material to have the yarn that has generated the entangling points and has been cleansed attached with the graphene-containing attachment material;

second rollers, which are arranged posterior to the material chamber to pull the yarn that has past the entangling point generator, the cleansing chamber, and the material chamber;

a heating chamber, which is arranged posterior to the second rollers to have the graphene-containing attachment material provided from the material chamber securely attached to each individual fiber of the yarn by means of heat-setting;

third rollers, which are arranged posterior to the heating chamber to control a heating time of the yarn in the heating chamber; and fourth rollers, which are arranged posterior to the third rollers;

wherein the graphene attachment material has a length of 3-20 μm, a width of 8-25 μm, and a thickness of 3-12 nm.

2. The yarn making method according to claim 1, wherein the raw-material yarn includes polyester false-twisted filament, nylon false-twisted filament, polyester/nylon filament, polyester/nylon fiber, and polyester/cotton blended yarn.

3. The yarn making method according to claim 1, wherein the first rollers pull 100-1000 meters per minute.

4. The yarn making method according to claim 1, wherein the entangling point generator operates an air jet nozzle to cause fibers to generate packed entangling phenomena in the form of points on polyester or nylon textured yarn during processing, so as to have the yarn generating 80-120 entangling points in each meter thereof.

5. The yarn making method according to claim 1, wherein the cleansing chamber applies a clear water rinsing process to wash out residual oil stains on the yarn.

6. The yarn making method according to claim 1, wherein the graphene-containing attachment material provided from the material chamber comprises a high molecular polymer and water.

7. The yarn making method according to claim 6, wherein the high molecular polymer comprises acrylic, or polyurethane (PU).

8. The yarn making method according to claim 1, wherein a ratio of graphene in entirety of the attachment material is from 0.1 percent to 3 percent.

9. The yarn making method according to claim 6, wherein a ratio of the high molecular polymer is from 10 percent to 50 percent, and a ratio of water is from 30 percent to 89.9 percent.

10. The yarn making method according to claim 6, wherein graphene, the high molecular polymer and water are stirred for 20-28 hours with a stirrer motor at a rotational speed of 1000-5000 revolutions per minute.

11. The yarn making method according to claim 1, wherein the second rollers pull 100-1000 meters per minute.

12. The yarn making method according to claim 1, wherein the heating chamber has a heating temperature of 100-600 degrees Celsius.

13. The yarn making method according to claim 1, wherein the third rollers pull 100-1000 meters per minute to control the heating time of the yarn in the heating chamber.

14. The yarn making method according to claim 1, wherein the fourth rollers pull 100-1000 meters per minute to wind and shape the yarn that has been processed.

15. The yarn making method according to claim 1, wherein for the raw-material yarn being a polyester filament (POY or FDY) or nylon filament (POY or NFDY), a pre-heating chamber is further arranged posterior to the first rollers, and a cooling board is further arranged posterior thereto, and a false-twisting mechanism is arranged posterior to the cooling board to make the polyester filament or the nylon filament into the textured yarn.

* * * * *